US012089713B2

(12) United States Patent
Kim

(10) Patent No.: US 12,089,713 B2
(45) Date of Patent: Sep. 17, 2024

(54) METHOD FOR PERMING EYELASH AND EYELASH PERMING KIT

(71) Applicant: Joo Hyun Kim, Busan (KR)

(72) Inventor: Joo Hyun Kim, Busan (KR)

( * ) Notice: Subject to any disclaimer, the term of this patent is extended or adjusted under 35 U.S.C. 154(b) by 281 days.

(21) Appl. No.: 17/716,720

(22) Filed: Apr. 8, 2022

(65) Prior Publication Data

US 2022/0330672 A1 Oct. 20, 2022

(30) Foreign Application Priority Data

Apr. 20, 2021 (KR) ..... 10-2021-0051336
Jul. 2, 2021 (KR) ..... 10-2021-0087104

(51) Int. Cl.
*A45D 2/48* (2006.01)

(52) U.S. Cl.
CPC ..... *A45D 2/48* (2013.01); *A45D 2200/25* (2013.01)

(58) Field of Classification Search
CPC ... A45D 2/48; A45D 2/14; A45D 7/00; A45D 7/04; A45D 7/06; A45D 2200/25; A45D 44/00; A45D 44/12; A45D 2007/004; A45D 40/30; A41G 5/02
USPC ..... 132/207, 210, 203, 216, 217
See application file for complete search history.

(56) References Cited

FOREIGN PATENT DOCUMENTS

| | | | |
|---|---|---|---|
| JP | H06105709 A | | 4/1994 |
| JP | 2021000450 A | * | 1/2021 |
| JP | 2021037070 A | | 3/2021 |
| KR | 20-0414548 | | 4/2006 |
| KR | 20-0442286 | | 10/2008 |
| KR | 10-2010-0043306 | | 4/2010 |
| KR | 10-1426304 | | 8/2014 |
| KR | 10-1768710 | | 8/2017 |
| KR | 10-2138308 | | 8/2020 |
| KR | 10-2225224 | | 3/2021 |

OTHER PUBLICATIONS

"Lifted. by LashBase Step by Step—Lash Lift & Tint." YouTube, YouTube, Sep. 4, 2020, www.youtube.com/watch?v=woFCmZdWWRk. (Year: 2020).*

(Continued)

*Primary Examiner* — Nicholas D Lucchesi
(74) *Attorney, Agent, or Firm* — ANTONIO HA & U.S. PATENT, LLC

(57) ABSTRACT

According to an embodiment, an eyelash perming method using an eye patch and an assemblable rod includes a silicone eye patch attaching step of attaching a silicone eye patch to a user's face, with a reference line of the silicone eye patch aligned with a portion under eyelashes of the user, a first perming step of combing to straighten down the eyelashes on the silicone eye patch and performing first perming the eyelashes, an eyelash cross-supporting step of fixing an eyelash cross support, including a vertical rod and a base, to the silicone eye patch, with the eyelashes disposed therebetween, to support the first-permed eyelashes in an upright position, a second perming step of combing to straighten the supported eyelashes and performing second perming on the eyelashes, and an eyelash cross support removing step of removing the eyelash cross support, at a predetermined time after the second perming is complete.

4 Claims, 12 Drawing Sheets

(56) References Cited

OTHER PUBLICATIONS

"Lash Lamination System Fall in The Volume Noble Lashes." Kris Nails, Aug. 5, 2010, krisnails.gr/en/product/lash-lamination-system-fall-in-the-volume-noble-lashes/. (Year: 2010).*
"Patented Reusable Silicone Pads." iLevel Lab, Sep. 25, 2020, www.eyelashextensionssupplies.com/products/reusable-silicone-pads. (Year: 2020).*
English Specification of 10-1426304.
English Specification of 10-2138308.
English Specification of 20-0414548.
English Specification of 20-0442286.
English Specification of JPH06105709A.
English Specification of 10-1768710.
English Specification of 10-2010-0043306.
English Specification of 10-2225224.
English Specification of JP2021037070A.

* cited by examiner

METHOD FOR PERMING EYELASH AND EYELASH PERMING KIT

CROSS-REFERENCE TO RELATED APPLICATION(S)

This application claims priority to Korean Patent Application Nos. 10-2021-0051336, filed on 2021 Apr. 20, and 10-2021-0087104, filed on Jul. 2, 2021, in the Korean Intellectual Property Office, the disclosures of which are incorporated by reference herein in their entireties.

TECHNICAL FIELD

Embodiments of the disclosure relate to eyelash perming and, more specifically, to an eyelash perming method and an eyelash perming kit used to perform the eyelash perming method.

DISCUSSION OF RELATED ART

An eyelash is one of the terminal hairs that grows about 10 mm long at the edge of the eyelids. About 100-150 eyelashes and about 70-80 eyelashes grow at the upper and lower eyelids, respectively.

Eyelashes are very sensitive, and immediately when they come in contact with foreign objects, such as dust, they close the upper and lower eyelids to protect the eyes.

As such, as originally designed to prevent foreign substances, dust, or rainwater from entering the eyes, eyelashes are left as they are. However, a recent trend is to beautify eyes by applying various beauty techniques to the eyelashes.

For example, women who pursue beauty prefer a method for creating a clear and distinct eye shape while making the eyes appear larger by forming curls with the eyelashes rolled up and outward.

As described above, tongs-shaped eyelash curlers are commonly used to make eyelashes curly. In other words, the user grips such tongs-shaped structure and presses to curl up the eyelashes.

However, to form curls on the eyelashes in this way, the eyelashes (including the hair roots) should be sturdy. However, in somewhat abnormal cases, such as when the eyelashes are short, the hair is not strong, the eyeballs are protruding, or eyelids are thick, it is not easy to form curls on the eyelashes, so that treatment should be preceded to strengthen the hair, i.e., perming.

However, since most of the conventional eyelash perming methods selectively use a glue or tape, it is not easy to perform the treatment. Further, due to its limitations in structure or method, the perm solution is not well permeated, so the treatment effect is poor.

Conventional eyelash perming has been conducted by applying a perm solution and naturally drying it and thus takes a long time without producing a significant effect. Thus, a need exists for addressing such drawbacks.

SUMMARY

According to an embodiment, an eyelash perming method using an eye patch and an assemblable rod comprises a silicone eye patch attaching step of attaching a silicone eye patch to a user's face, with a reference line of the silicone eye patch aligned with a portion under eyelashes of the user, a first perming step of combing to straighten down the eyelashes on the silicone eye patch and performing first perming the eyelashes, an eyelash cross-supporting step of fixing an eyelash cross support, including a vertical rod and a base, to the silicone eye patch, with the eyelashes disposed therebetween, to support the first-firmed eyelashes in an upright position, a second perming step of combing to straighten the supported eyelashes and performing second perming on the eyelashes, and an eyelash cross support removing step of removing the eyelash cross support, a predetermined time after the second perming is complete.

The eyelash perming method may further comprise an assemblable horizontal rod placing step of placing an assemblable horizontal rod, including a first unit rod and a second unit rod, opposite the silicone eye patch, with the eyelashes disposed therebetween, after the eyelash cross support removing step.

The eyelash perming method may further comprise a third perming step of combing to straighten up the eyelashes on the assemblable horizontal rod and performing third perming after the assemblable horizontal rod placing step.

The eyelash perming method may further comprise a foil eye patch placing step of covering the eyelashes with first and second aluminum foil eye patches when performing the third perming.

According to an embodiment, an eyelash perming kit may comprise a silicone eye patch placed under eyelashes, an eyelash cross support installed on the silicone eye patch to crossingly support the eyelashes, an assemblable horizontal rod placed opposite the silicone eye patch, with the eyelashes disposed therebetween, and first and second aluminum foil eye patches covering the eyelashes when perming is performed on the eyelashes.

The silicone eye patch may include a patch body having a reference line on a side thereof and a plurality of cuts on an opposite side of the reference line. The eyelash cross support may include a vertical rod and a base supporting the vertical rod. The assemblable horizontal rod may include a first unit rod and a second unit rod detachably assembled together in a lengthwise direction thereof.

Embodiments of the disclosure enable eyelash perming with better quality and in a more effective way and allows for an eyelash perm to last for a long time.

DETAILED DESCRIPTION

Figure 1:
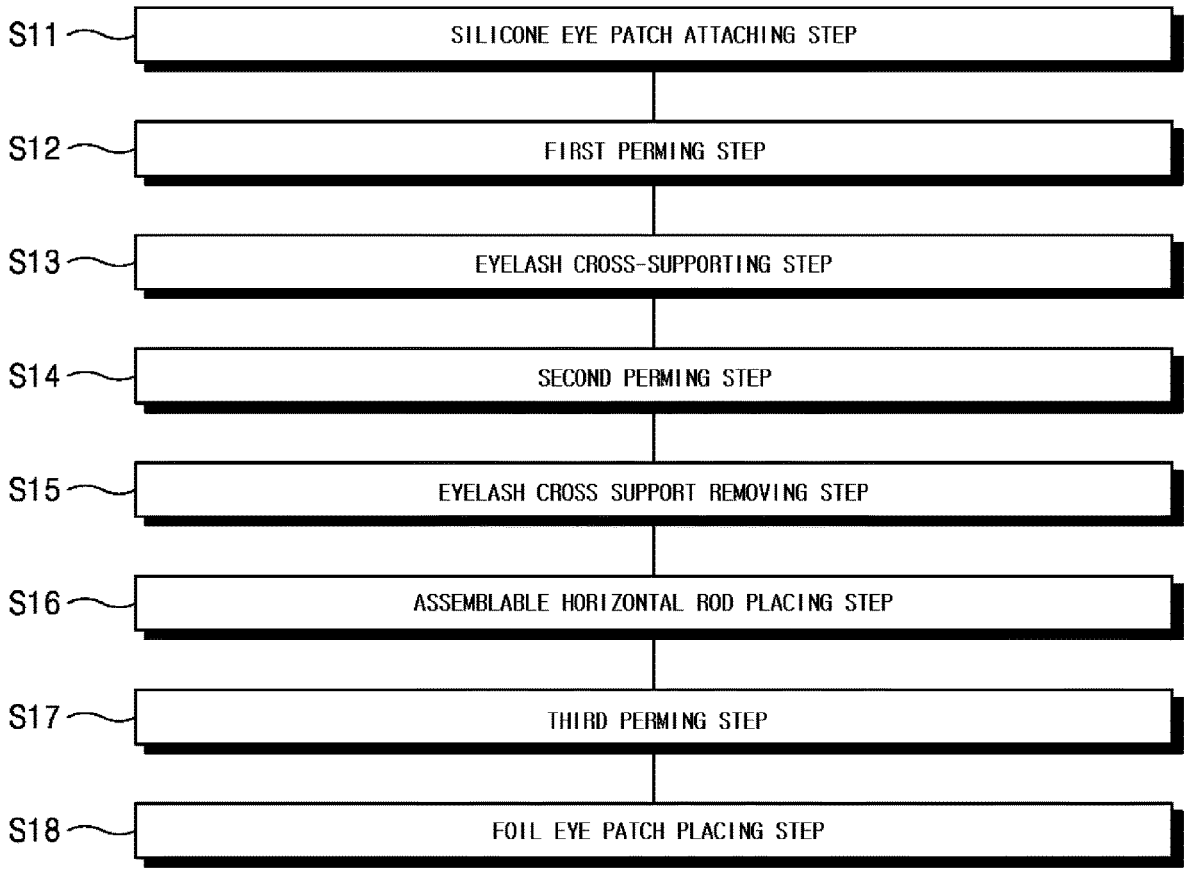
FIG. 1 is a flowchart illustrating an eyelash perming method using an eye patch and an assemblable rod according to an embodiment.

Advantages and features of the disclosure, and methods for achieving the same may be apparent from the embodiments described below with reference to the accompanying drawings.

However, the scope of the disclosure is not limited to embodiments described herein, but rather, other various changes may be made thereto.

However, the present disclosure is not limited to the embodiments disclosed herein, and various changes may be made thereto. The embodiments disclosed herein are provided only to inform one of ordinary skilled in the art of the category of the present disclosure. The present disclosure is defined only by the appended claims. The scope of the disclosure is defined by the appended claims.

In some embodiments, known components, operations, and techniques are not described in detail to avoid the disclosure from ambiguity in interpretation.

The same reference numeral denotes the same element throughout the specification. The terms as used herein are provided merely to describe some embodiments thereof, but not intended as limiting the disclosure.

As used herein, the singular forms "a," "an," and "the" are intended to include the plural forms as well, unless the context clearly indicates otherwise. As used herein, the term "comprises" and/or "comprising" does not exclude the presence or addition of one or more other components, steps, operations, and/or elements than the component, step, operation, and/or element already mentioned.

Unless defined otherwise, all the terms (including technical and scientific terms) used herein may be construed as commonly appreciated by one of ordinary skill in the art to which the disclosure pertains.

Further, terms defined in a dictionary commonly used are not ideally or overly interpreted unless defined expressly or specifically.

Hereinafter, embodiments of the disclosure are described in detail with reference to the accompanying drawings.

Figure 2:
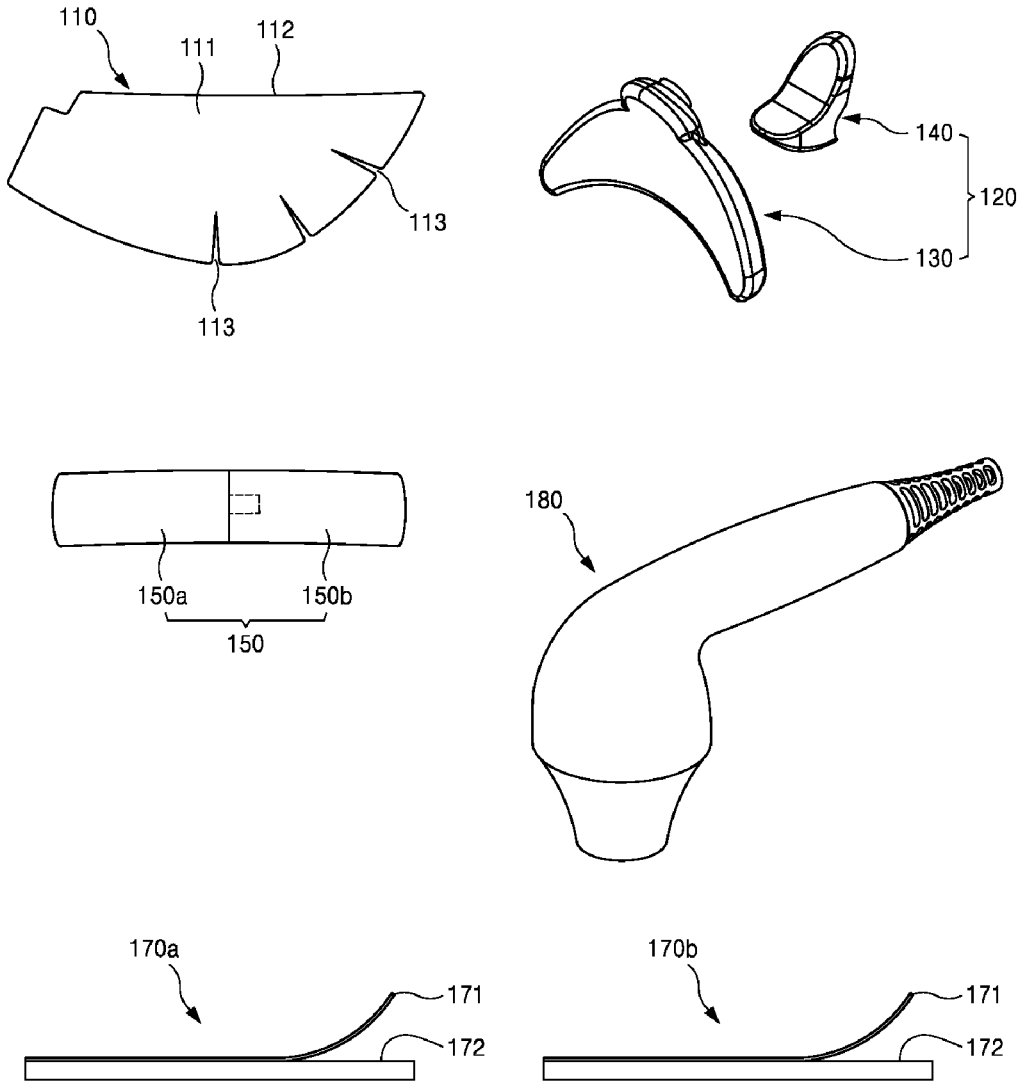
FIG. 2 is a view illustrating a configuration of an eyelash perming kit for performing the eyelash perming method of FIG. 1.

FIG. 1 is a flowchart illustrating an eyelash perming method using an eye patch and an assemblable rod according to an embodiment. FIG. 2 is a view illustrating a configuration of an eyelash perming kit for performing the eyelash perming method of FIG. 1. FIGS. 3, 4, 5, 6, 7, 8, 9, 10, 11, and 12 are views illustrating each step of an eyelash perming method according to an embodiment.

Embodiments of the disclosure enable eyelash perming with better quality and in a more effective way while ensuring a long-term effect.

Referring to FIG. 1, according to an embodiment, an eyelash perming method using an eye patch and an assemblable rod includes a silicone eye patch attaching step S11, a first perming step S12, an eyelash cross-supporting step S13, a second perming step S14, an eyelash cross-support removing step S15, an assemblable horizontal rod placing step S16, a third perming step S17, and a foil eye patch placing step S18. The eyelash perming method may enable eyelash perming with superior quality.

To perform the eyelash perming method, an appropriate device, e.g., an eyelash perming kit is needed. The eyelash perming kit is described with reference to FIG. 2.

According to an embodiment, an eyelash perming kit may include a silicone eye patch 110, an eyelash cross support 120, an assemblable horizontal rod 150, and first and second aluminum foil eye patches 170*a* and 170*b*.

The silicone eye patch 110 is placed under the eyelashes to be treated. The second insertion portion may be placed on the user's face.

The silicone eye patch 110 may include a patch body 111 having a reference line 112 on a side and a plurality of cuts 113 formed in the patch body 111 on a side opposite to the reference line 112 to be spread. The reference line 112 serves as a reference for placing the silicone eye patch 110 under the target eyelashes. The cuts 113 allow the patch body 111 to be spread flat without a fold.

The eyelash cross support 120 is installed on the silicone eye patch 110 to crossingly support up the eyelashes. In other words, the eyelash cross support 120 is a means for perming eyelashes after erecting and combing the eyelashes.

The eyelash cross support 120 may include a vertical rod 130 for crossingly supporting up the eyelashes and a base 140 for supporting the vertical rod 130 to be supported in an upright position. The vertical rod 130 and the base 140 may be attached to each other by, e.g., a double-sided tape.

The assemblable horizontal rod 150 is a structure disposed opposite the silicone eye patch 110 with the eyelashes disposed therebetween. The assemblable horizontal rod 150 may be formed of a synthetic resin and be assembled and used.

The assemblable horizontal rod 150 may include a first unit rod 150*a* and a second unit rod 150*b* that are detachably assembled (or attached or coupled) to each other in a lengthwise direction thereof. Alternatively, three or more unit rods may be used.

The first and second aluminum foil eye patches 170*a* and 170*b* assists perming when the perming proceeds on the assemblable horizontal rod 150. Each of the aluminum foil eye patches 170 may include two layers 171 and 172. In other words, the first and second aluminum foil eye patches 170*a* and 170*b* keep the heat from escaping.

A thermal infrared radiator 180 may be used to heat the perm solution. Other components, e.g., a timer, may be further included.

Figure 3:
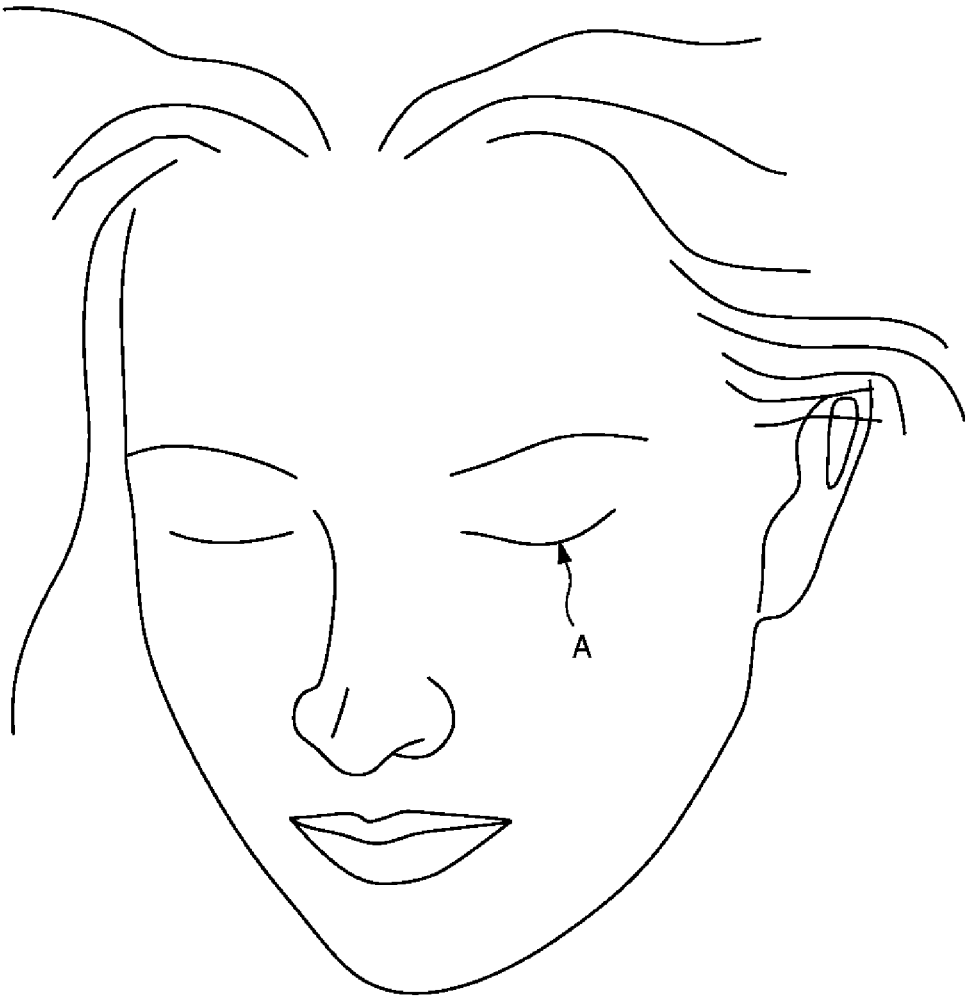
FIGS. 3, 4, 5, 6, 7, 8, 9, 10, 11, and 12 are views illustrating each step of an eyelash perming method according to an embodiment.

An eyelash perming method using an eye patch and an assemblable rod according to an embodiment is described below. It is hypothesized that eyelashes in area A of FIG. 3 are permed.

Figure 4:
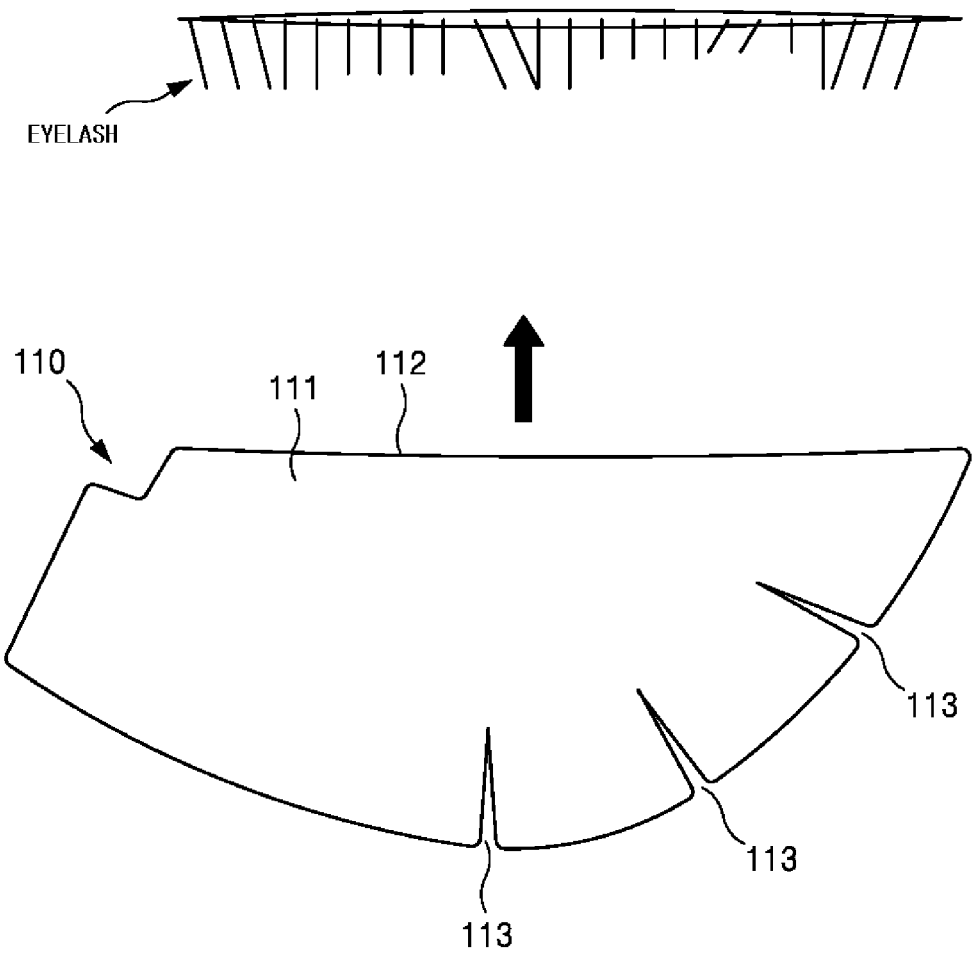
Figure 5:
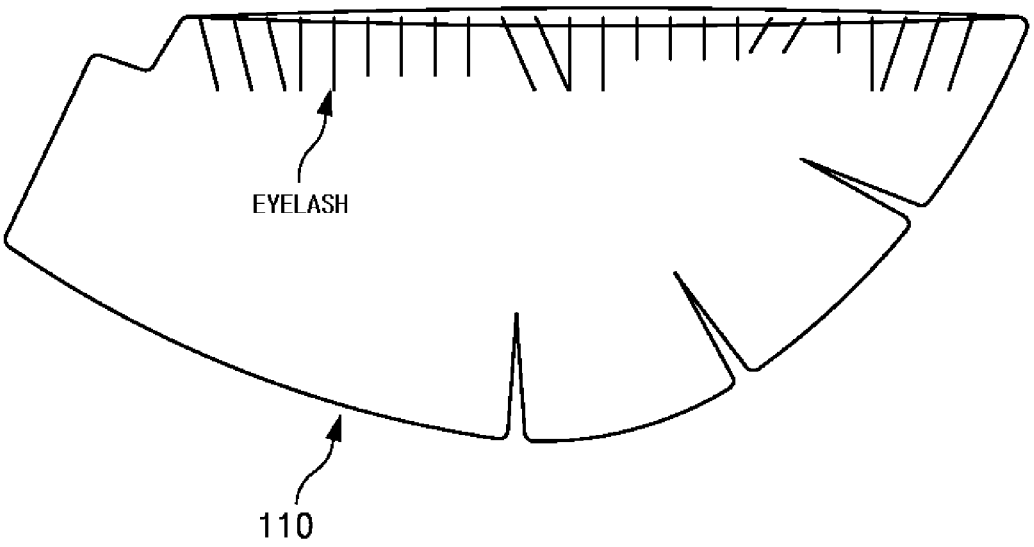

In the silicone eye patch attaching step S11, the silicone eye patch 110 is attached to the corresponding portion of the user's face, with the reference line 112 of the patch body 111 aligned with (or abutting or positioned adjacent to) the portion under the target eyelashes as shown in FIGS. 4 and 5. The silicone eye patch 110 contains a sticky material to allow the silicone eye patch 110 to be attached to the user's face.

Figure 6:
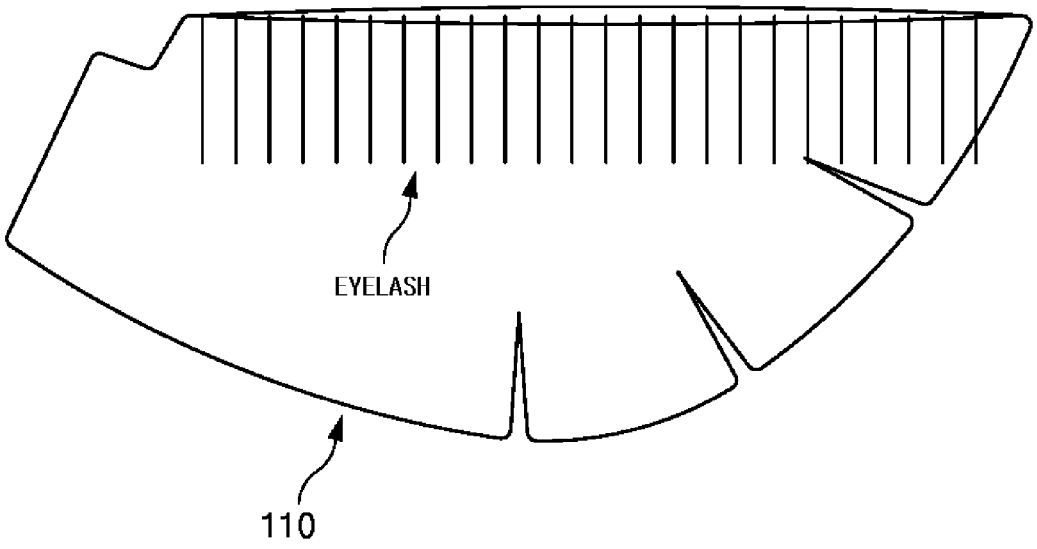

In the first perming step S12, the eyelashes are combed to be straightened down, on the silicone eye patch 110, and is subjected to first perming, as shown in FIG. 6.

Figure 7:
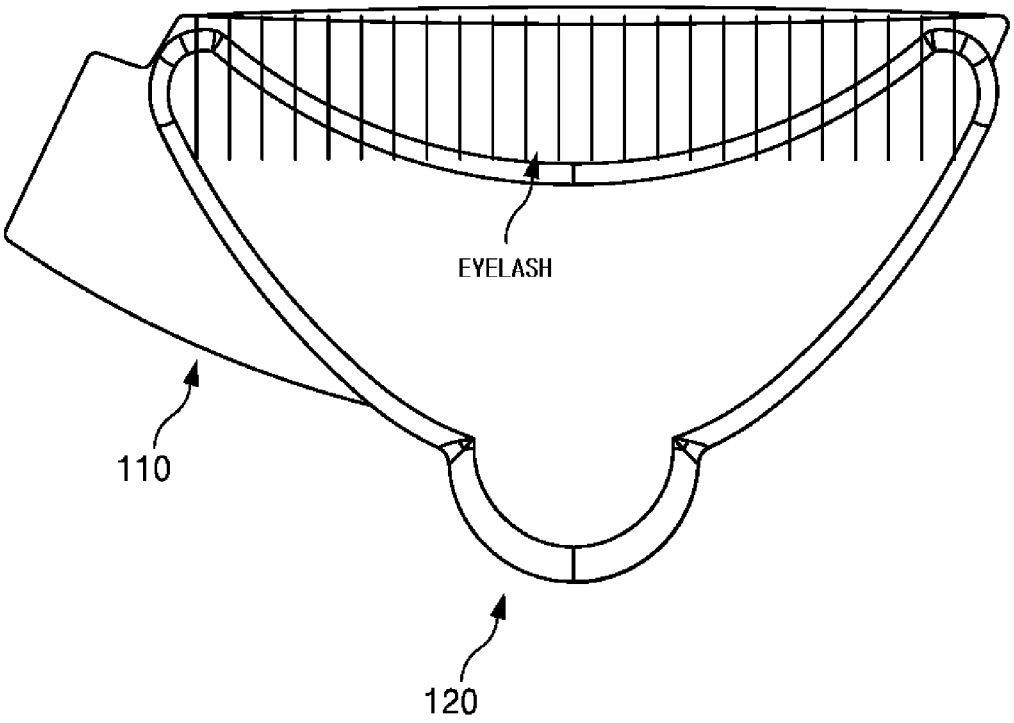
Figure 8:
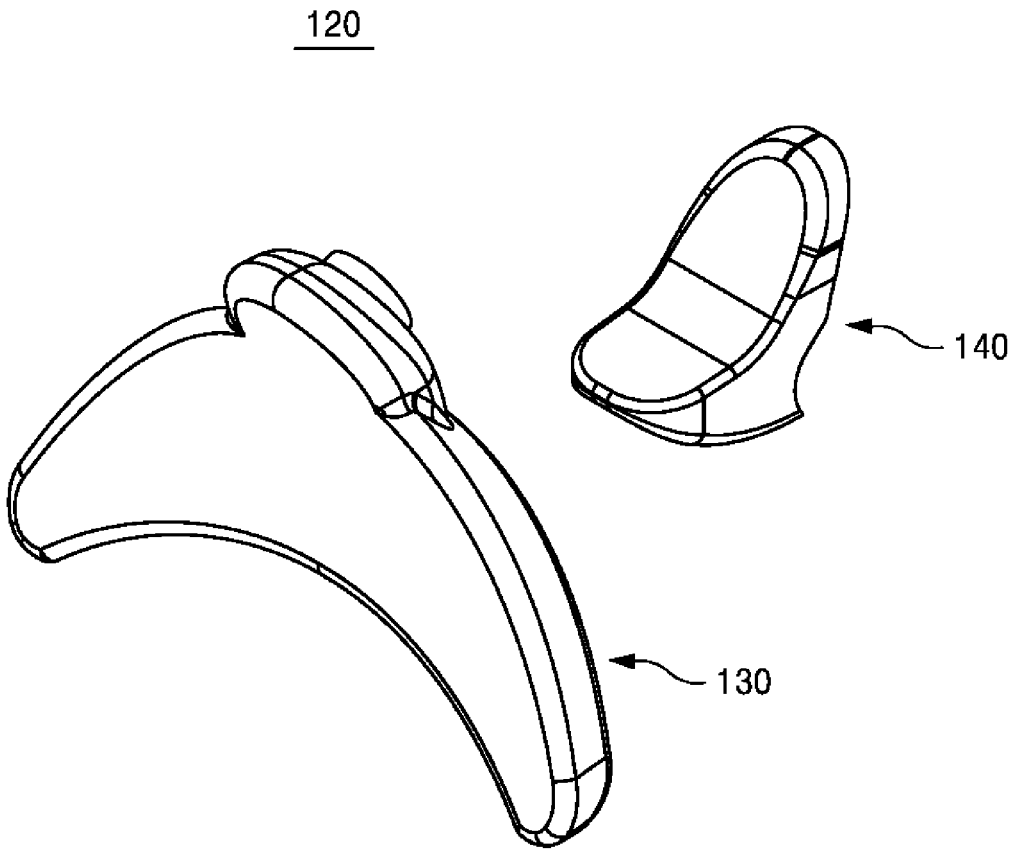

In the eyelash cross-supporting step S13, the eyelash cross support 120 including the vertical rod 130 and the base 140 is assembled and is fixed to the silicone eye patch 110, with the eyelashes disposed therebetween, so that the first-permed eyelashes are crossingly supported up, as shown in FIGS. 7 and 8.

Figure 9:
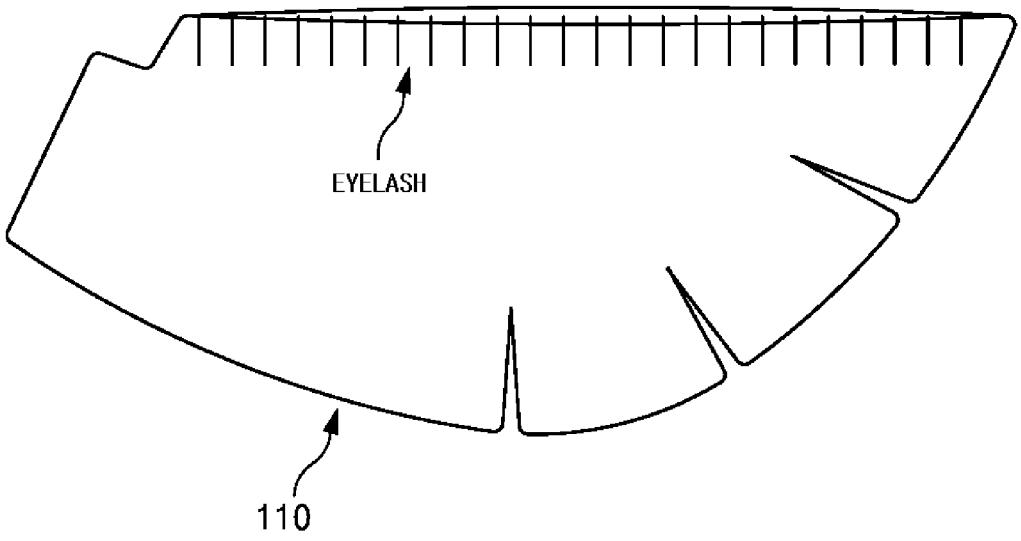

In the second perming step S14, the eyelashes, crossingly supported by the eyelash cross support 120, are spread out and secondly permed. In the eyelash cross support removing step S15, a predetermined time after the second perming is complete, the eyelash cross support 120 is removed as shown in FIG. 9.

Figure 10:
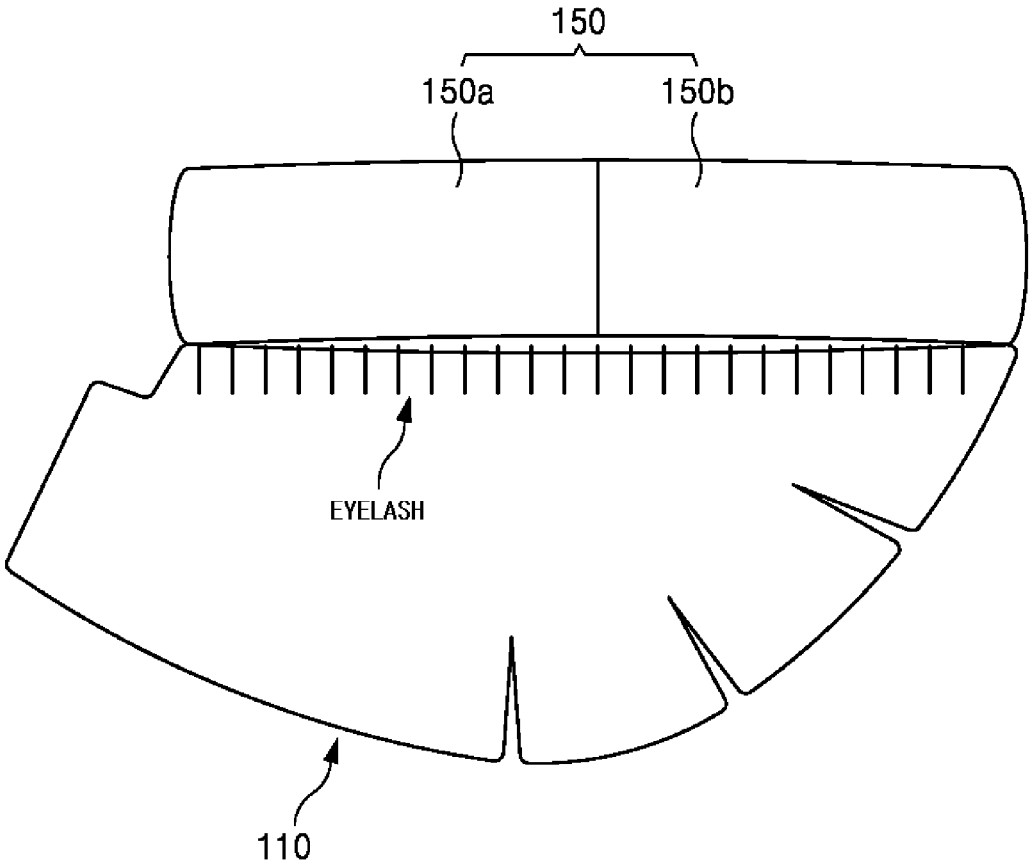

In the assemblable horizontal rod placing step S16, the assemblable horizontal rod 150, resultant from assembling the first unit rod 150*a* and the second unit rod 150*b*, is placed opposite the silicone eye patch 110, with the eyelashes disposed therebetween, as shown in FIG. 10.

Figure 11:
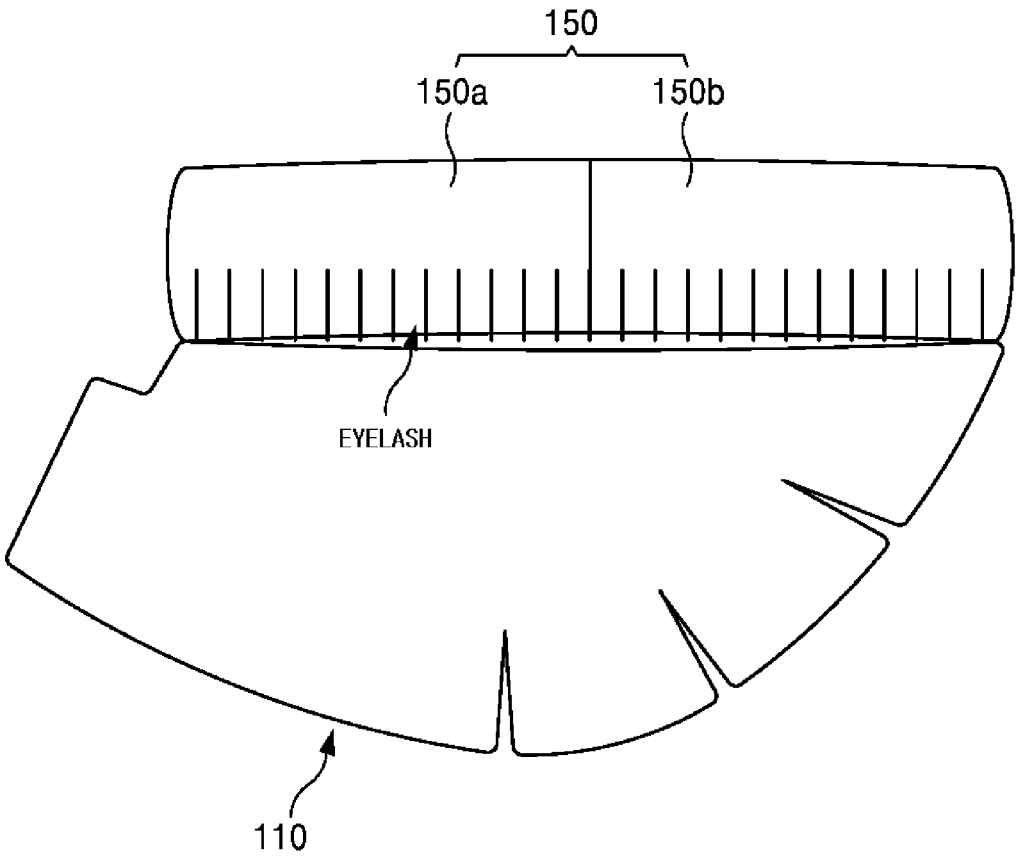

In the third perming step S17, the eyelashes are combed to be straightened up on the assemblable horizontal rod 150 and is subjected to third perming as shown in FIG. 11.

Figure 12:
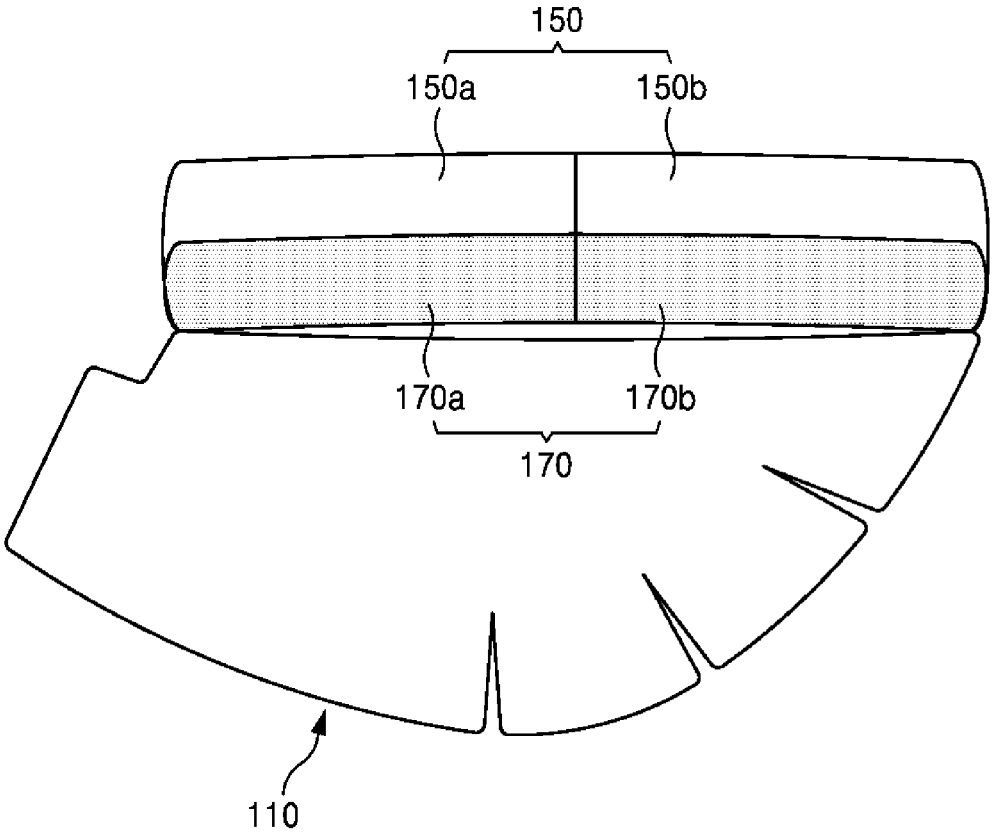

In the foil eye patch placing step S18, the eyelashes are covered with the first and second aluminum foil eye patches 170*a* and 170*b* when the third perming is performed, as shown in FIG. 12.

Described below is a series of eyelash perming process according to an embodiment.

As shown in FIGS. 4 and 5, the silicone eye patch 110 is attached in the corresponding position, with the reference line 112 of the patch body 111 abutting the portion under the target eyelashes. As described above, the patch body 111 of the silicone eye patch 110 has a sticky material on a surface thereof so that the silicone eye patch 110 is well attached to the user's face.

Then, the eyelashes are combed to be straightened down, on the silicone eye patch 110, and is subjected to first perming, as shown in FIG. 6. By combing to straighten down the eyelashes on the silicone eye patch 110 before performing the first perming, a better perm may be obtained.

Then, the eyelash cross support 120 including the vertical rod 130 and the base 140 is assembled and is fixed to the silicone eye patch 110, with the eyelashes disposed therebetween, so that the first-permed eyelashes are crossingly supported up, as shown in FIGS. 7 and 8. By performing additional perming in the upright position of the eyelashes, a more secure perm may be obtained and last longer.

Then, the eyelashes crossingly supported by the eyelash cross support 120 are combed to be straightened and are then subjected to second perming. A predetermined time after the second perming is complete, the eyelash cross support 120 is removed as shown in FIG. 9.

Then, as shown in FIG. 10, the assemblable horizontal rod 150, which is the assembly of the first unit rod 150*a* and the second unit rod 150*b*, is placed opposite the silicone eye patch 110, with the eyelashes disposed therebetween. Then, the eyelashes are combed to be straightened on the assemblable horizontal rod 150 and are subjected to third perming as shown in FIG. 11. By combing to straighten up the eyelashes on the assemblable horizontal rod 150 before performing the third perming, a better perm may be obtained.

When the third perming is performed, the eyelashes are covered with the first and second aluminum foil eye patches 170*a* and 170*b* as shown in FIG. 12, and after a predetermined time, all the components are removed.

Embodiments of the disclosure, as described above, allow for eyelash perming with better quality and in a more effective manner.

It is appreciated by one of ordinary skilled in the art that the scope of the disclosure is not limited to the embodiments set forth herein, and various changes or modifications may be made thereto without departing from the scope and spirit of the disclosure. Thus, such changes or modifications also belong to the scope of the disclosure defined by the appended claims.

What is claimed is:

1. An eyelash perming method using an eye patch and an assemblable rod, comprising:

a silicone eye patch attaching step of attaching a silicone eye patch to a user's face, with a reference line of the silicone eye patch aligned with a portion under eyelashes of the user;

a first perming step of combing to straighten down the eyelashes on the silicone eye patch and performing first perming on the eyelashes;

an eyelash cross-supporting step of fixing an eyelash cross support, including a vertical rod and a base, to the silicone eye patch, with the eyelashes disposed therebetween, to support the first permed eyelashes in an upright position;

a second perming step of combing to straighten the supported eyelashes and performing second perming on the eyelashes; and an eyelash cross support removing step of removing the eyelash cross support, at a predetermined time after the second perming is complete.

2. The eyelash perming method of claim 1, further comprising an assemblable horizontal rod placing step of placing an assemblable horizontal rod, including a first unit rod and a second unit rod, opposite the silicone eye patch, with the eyelashes disposed therebetween, after the eyelash cross support removing step.

3. The eyelash perming method of claim 2, further comprising a third perming step of combing to straighten up the eyelashes on the assemblable horizontal rod and performing third perming after the assemblable horizontal rod placing step.

4. The eyelash perming method of claim 3, further comprising a foil eye patch placing step of covering the eyelashes with first and second aluminum foil eye patches when performing the third perming.

* * * * *